US008319135B2

(12) United States Patent
Chen et al.

(10) Patent No.: US 8,319,135 B2
(45) Date of Patent: Nov. 27, 2012

(54) ELECTRONIC DEVICE AND SLIDE SWITCH THEREOF

(75) Inventors: Chung-Yuan Chen, Taipei Hsien (TW); Kok-Kan Chan, Taipei Hsien (TW); Hua-Lin Lv, Shenzhen (CN); Jing Liu, Shenzhen (CN); Yu Zou, Shenzhen (CN); Chu-Lien Liu, Taipei Hsien (TW); Ting-Jian Zou, Shenzhen (CN); Zuo-Dong Li, Shenzhen (CN)

(73) Assignees: Fu Tai Hua Industry (Shenzhen) Co., Ltd., ShenZhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 327 days.

(21) Appl. No.: 12/869,781

(22) Filed: Aug. 27, 2010

(65) Prior Publication Data

US 2011/0291535 A1 Dec. 1, 2011

(51) Int. Cl.
*H01H 15/10* (2006.01)

(52) U.S. Cl. ..... 200/547; 200/536

(58) Field of Classification Search ..... 200/547, 200/548–550, 536, 562, 563
See application file for complete search history.

(56) References Cited

U.S. PATENT DOCUMENTS

| | | | | |
|---|---|---|---|---|
| 6,825,430 | B2 * | 11/2004 | Wong et al. | 200/547 |
| 7,679,017 | B1 * | 3/2010 | Tsai | 200/547 |
| 8,143,545 | B2 * | 3/2012 | Zuo | 200/547 |
| 8,253,053 | B2 * | 8/2012 | Yang et al. | 200/547 |

* cited by examiner

*Primary Examiner* — Xuong Chung Trans
(74) *Attorney, Agent, or Firm* — Altis Law Group, Inc.

(57) ABSTRACT

An electronic device and a slide switch are disclosed. The slide switch includes a main body, a slider, a rotary plate rotatably connected to the main body, and a rotary arm. The main body includes a fixing space, a channel, and a first contact member protruding from a bottom of the fixing space. The slider is movable between a first position and a second position within the channel. The rotary plate includes a lateral surface and a second contact member protruding from the lateral surface. Two ends of the rotary arm are respectively connected to the slider and the lateral surface. When the slider is located in the first position, the first contact member spaces from the second contact member; when the slider is moved to the second position, the rotary arm rotates the rotary plate causing the first contact member to contact the second contact member.

10 Claims, 5 Drawing Sheets

ELECTRONIC DEVICE AND SLIDE SWITCH THEREOF

BACKGROUND

1. Technical Field

The present disclosure relates to electronic devices and slide switches thereof.

2. Description of the Related Art

Generally, a slide switch is commonly used in electronic devices, e.g. mobile phones. Compared to press switches, the slide switches have many advantages. For example, the slide switch is suitable to be in a user's pocket, because they cannot be accidentally pressed.

BRIEF DESCRIPTION OF THE DRAWINGS

The components of the drawings are not necessarily drawn to scale, the emphasis instead being placed upon clearly illustrating the principles of an electronic device and a slide switch thereof. Moreover, in the drawings, like reference numerals designate corresponding parts throughout several views.

DETAILED DESCRIPTION

Figure 1:
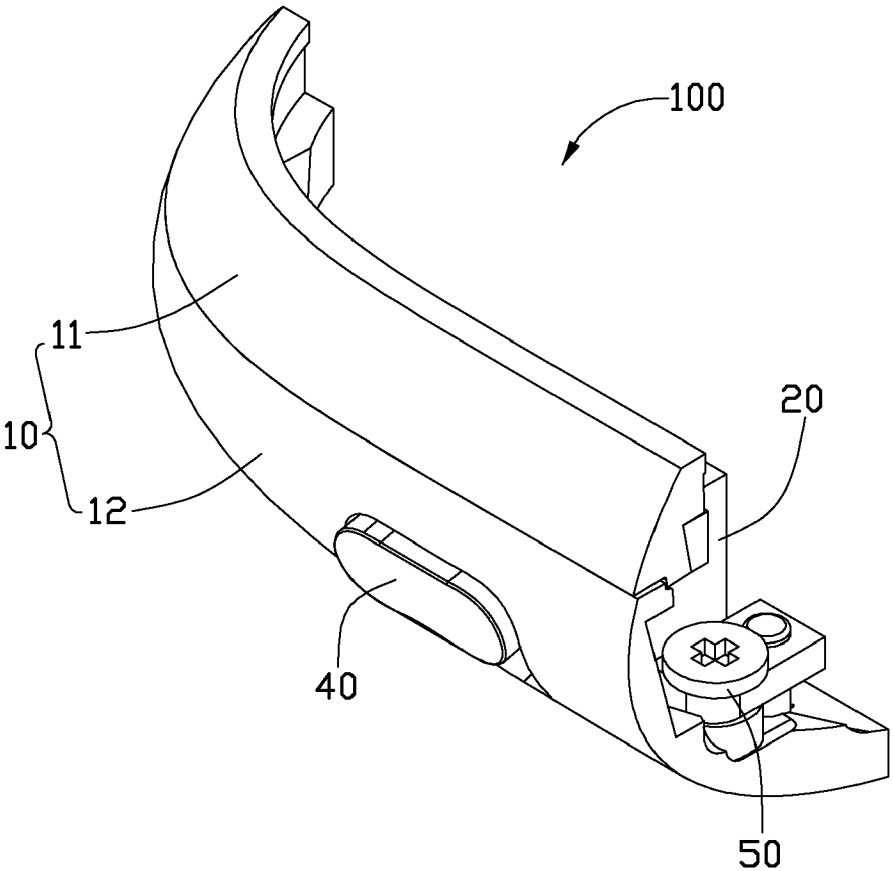
FIG. 1 is a schematic view of a portion of an electronic device with a slide switch according to an exemplary embodiment.
Figure 2:
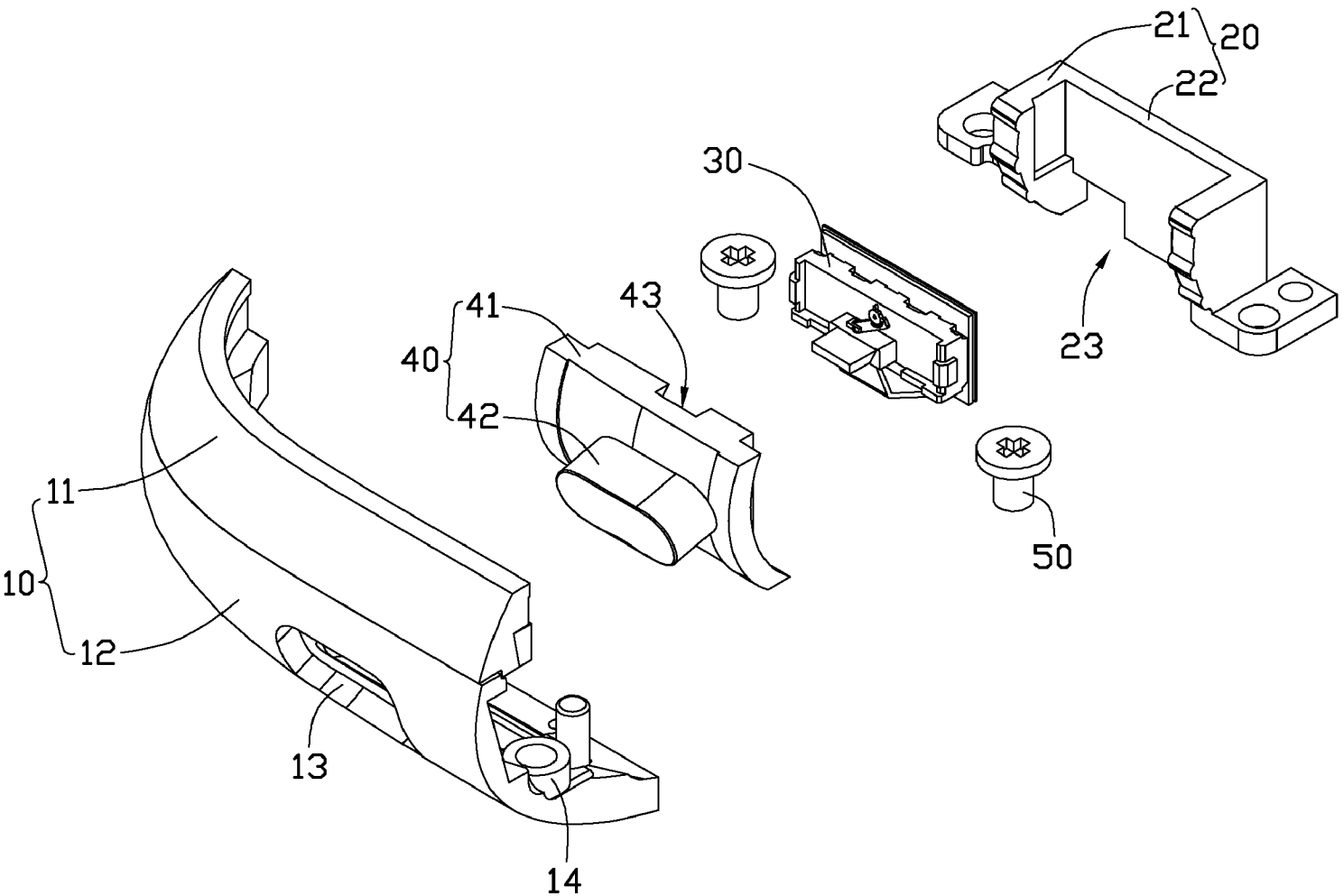
FIG. 2 is an exploded view of the portion of the electronic device of FIG. 1.
Figure 3:
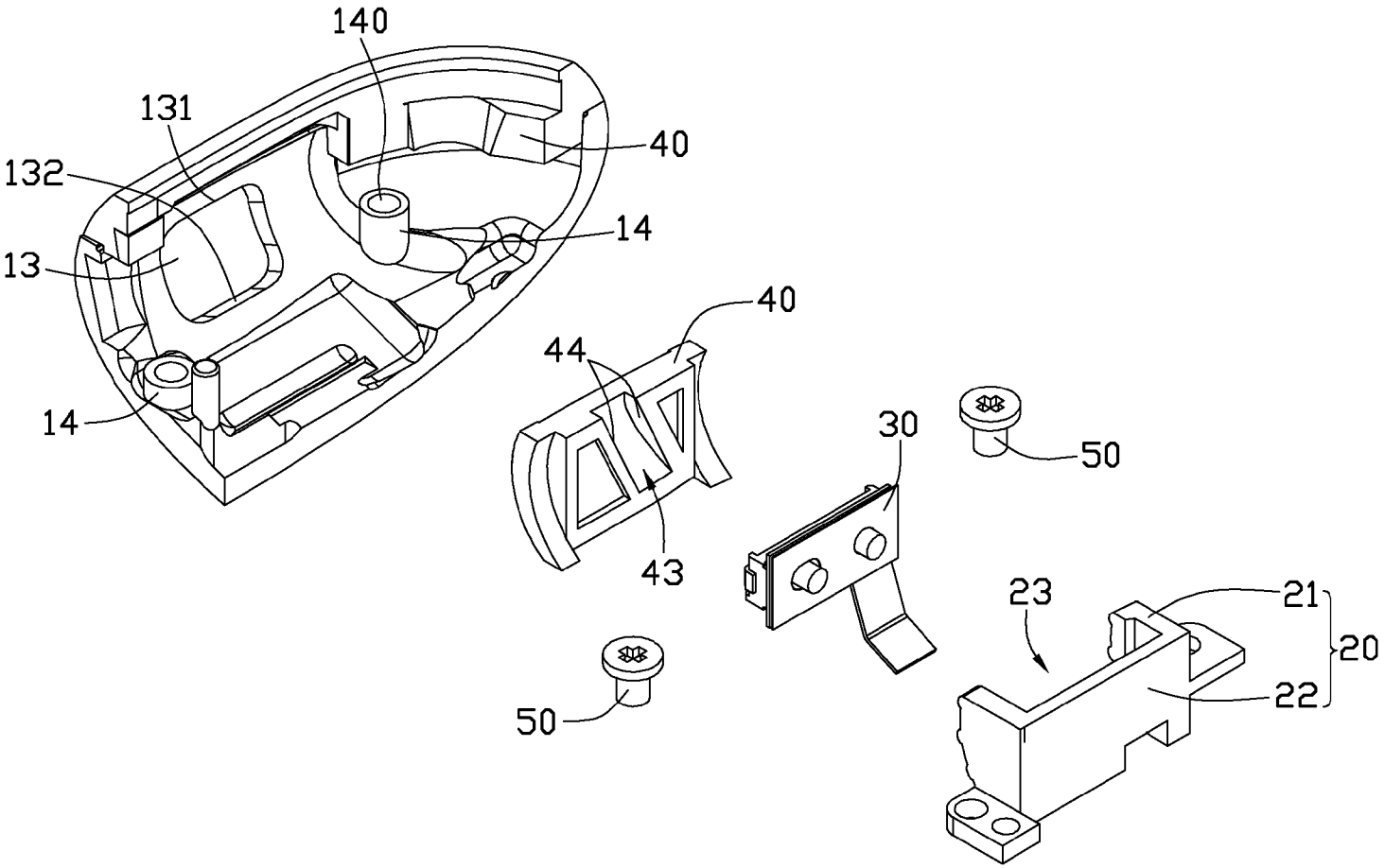
FIG. 3 is similar to FIG. 2, but viewed from a reverse perspective.

Referring to FIGS. 1-3, a portion of an electronic device 100 according to an exemplary embodiment is illustrated. The electronic device 100 includes a housing 10, a base 20, a slide switch 30, a button 40, and two fasteners 50.

The housing 10 includes an upper housing 11 and a lower housing 12 fastened together. The lower housing 12 defines an opening 13 and two support posts 14. The opening 13 includes a first edge 131 and a second edge 132 substantially parallel to the first edge 131. The support posts 14 each define a receiving hole 140 for receiving one fastener 50, such that the base 20 can be connected to the support posts 14 by the fasteners 50 received in the receiving holes 140.

The base 20 includes two opposite side plates 21 and a connecting plate 22 between the two side plates 21. The two side plates 21 and the connecting plate 22 cooperatively define a receiving space 23 facing toward the opening 13.

Figure 4:
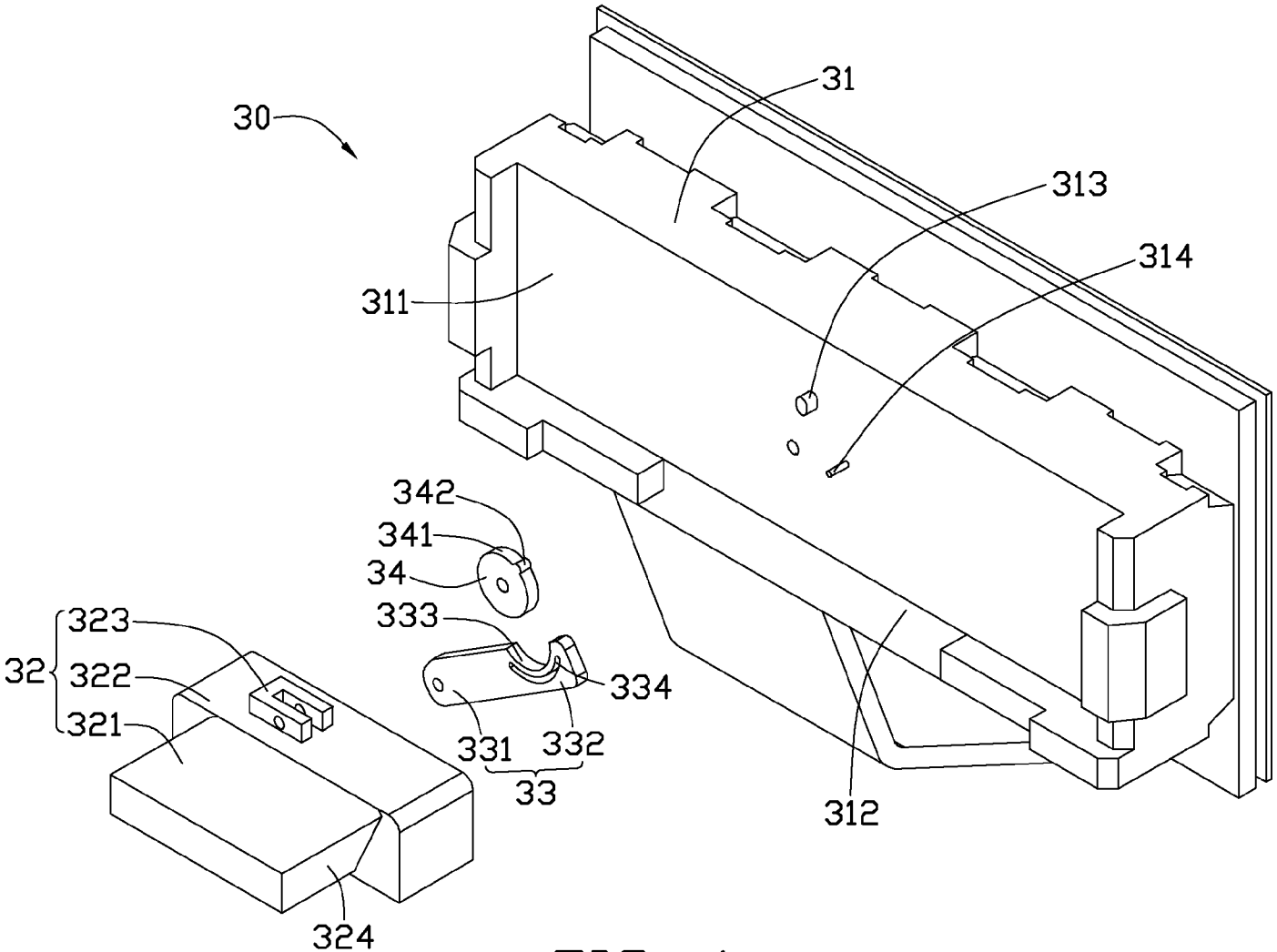
FIG. 4 is an exploded view of the slide switch of the electronic device of FIG. 2.

Referring also to FIG. 4, the slide switch 30 includes a main body 31, a slider 32, a rotary arm 33, and a rotary plate 34. The main body 31 is secured in the receiving space 23 of the base 20, and defines a fixing space 311 and a channel 312 facing toward the button 40. The main body 31 includes a first contact member 313 and a guide pin 314 both protruding from a bottom of the fixing space 311.

The slider 32 includes a movable member 322, a protrusion 321 protruding from a front surface of the movable member 322, and a seat 323 formed on a top surface of the movable member 322. The protrusion 321 includes two opposite side surfaces 324. The movable member 322 is movable between a first position and a second position within the channel 312 of the main body 31.

The rotary arm 33 includes a connecting end 331 and a free end 332 opposite to the connecting end 331. The connecting end 331 is rotatably connected to the seat 323 of the slider 32. The free end 332 includes an arc-shaped recess 333 and a guide slot 334 substantially parallel to each other. The guide pin 314 of the main body 31 extends through the guide slot 334.

The rotary plate 34, including a lateral surface 341 and a second contact member 342 protruding from the lateral surface 341, is rotatably connected to the main body 31. The recess 333 is configured to abut against a portion of the lateral surface 341. When the slider 32 slides, the connecting end 331 of the rotary arm 33 rotates about its axis of rotation, and the free end 332 is guided by the guide pin 314 to rotate around the lateral surface 341, which drives the rotary plate 34 to rotate.

The button 40 includes an urging member 41 and a pushing member 42 protruding from the urging member 41. The urging member 41 defines a slot 43 extending tipsily from its top to its bottom. The slot 43 includes two opposite side surfaces 44. The protrusion 321 of the slider 32 is partially received in the slot 43. The side surfaces 44 are configured to abut against the two side surfaces 324 to push the slider 32 to move. The pushing member 42 is movably received in the opening 13 and can move between the first edge 131 and the second edge 132 of the opening 13 of the housing 10.

Figure 5:
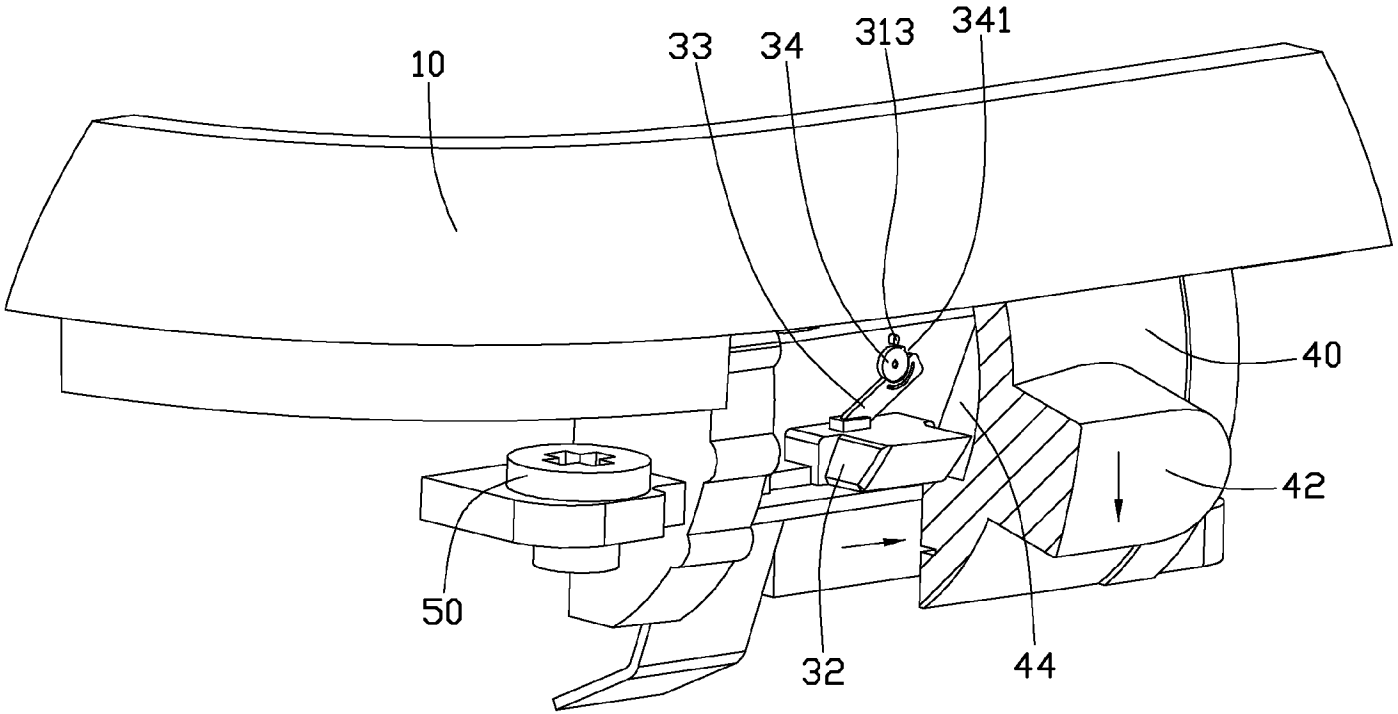
FIG. 5 is a cutaway view of the portion of the electronic device of FIG. 1.

Referring to FIG. 5, the slider 32 is located in the first position within the channel 312 of the main body 31. The button 40 is in contact with the first edge 131, and the second contact member 342 spaces from the first contact member 313. When the button 40 is pushed downwardly from the first edge 131 to the second edge 132, the side surfaces 44 drive the slider 32 to move toward a second position, as indicated by the arrows of FIG. 5. The rotary arm 43 rotates the rotary plate 44, causing the second contact member 342 to contact the first contact member 313. Thus, the slide switch 30 is actuated.

Finally, while the present disclosure has been described with reference to particular embodiments, the description is illustrative of the disclosure and is not to be construed as limiting the disclosure. Therefore, various modifications can be made to the embodiments by those of ordinary skill in the art without departing from the true spirit and scope of the disclosure as defined by the appended claims.

What is claimed is:

1. An electronic device comprising:

a housing defining an opening comprising a first edge and a second edge substantially parallel to the first edge;

a button comprising an urging member and a pushing member protruding from the urging member, wherein the urging member defines a slot comprising two opposite side surfaces and the pushing member is movably received in the opening; and a slide switch comprising:

a main body, defining a fixing space, a channel and a first contact member protruding from a bottom of the fixing space;

a slider comprising a movable member and a protrusion protruding from a front surface of the movable member, wherein the movable member is movably connected to the main body and able to slide between a first position and a second position within the channel, the protrusion is partially received in the slot of the button, and the protrusion includes two opposite side surfaces abutting against the two side surfaces of the slot;

a rotary plate rotatably connected to the main body and comprising a lateral surface and a second contact member protruding from the lateral surface; and a rotary arm comprising a connecting end connected to the slider and a free end connected to the lateral surface of the rotary plate;

wherein when the pushing member is pushed from the first edge to the second edge, the two side surfaces of the slot drive the slider to move from the first position to the second position, the rotary arm rotates about its axis of rotation to rotate the rotary plate, and the second contact member contacts the first contact member to actuate the slide switch.

2. The electronic device as described in claim 1, further comprising a base and two fasteners fastening the base to the housing, wherein the slide switch is connected to the base.

3. The electronic device as described in claim 2, wherein the base comprises two opposite side plates and a connecting plate between the two side plates, the two side plates and the connecting plate cooperatively define a receiving space for receiving the slide switch.

4. The electronic device as described in claim 1, wherein the slider further comprises a seat formed on a top surface of the movable member, and the connecting end of the rotary arm is rotatably connected to the seat.

5. The electronic device as described in claim 1, wherein the rotary arm defines an arc-shaped recess abutting against a portion of the lateral surface of the rotary plate.

6. The electronic device as described in claim 5, wherein the main body defines a guide pin protruding from a bottom of the fixing space and the rotary arm defines a guide slot parallel to the recess for the guide pin extending through.

7. A slide switch comprising:

a main body defining a channel and a fixing space, comprising a first contact member protruding from a bottom of the fixing space;

a slider movably connected to the main body and able to slide between a first position and a second position within the channel;

a rotary plate rotatably connected to the main body and comprising a lateral surface and a second contact member protruding from the lateral surface; and a rotary arm comprising a connecting end connected to the slider and a free end connected to the rotary plate, wherein:

when the slider is located in the first position, the first contact member spaces from the second contact member; and when the slider is moved to the second position, the rotary arm rotates the rotary plate, causing the first contact member to contact the second contact member.

8. The slide switch as described in claim 7, wherein the slider comprises a movable member and a seat formed on a top surface of the movable member, the movable member is movable between the first position and the second position within the channel, and the connecting end of the rotary arm is rotatably connected to the seat.

9. The slide switch as described in claim 7, wherein the rotary arm defines an arc-shaped recess abutting against a portion of the lateral surface of the rotary plate.

10. The slide switch as described in claim 9, wherein the main body defines a guide pin protruding from a bottom of the fixing space and the rotary arm defines a guide slot parallel to the recess for the guide pin extending through.

* * * * *

UNITED STATES PATENT AND TRADEMARK OFFICE

CERTIFICATE OF CORRECTION

PATENT NO. : 8,319,135 B2
APPLICATION NO. : 12/869781
DATED : November 27, 2012
INVENTOR(S) : Chung-Yuan Chen et al.

It is certified that error appears in the above-identified patent and that said Letters Patent is hereby corrected as shown below:

Title Page, below Item (65) insert

-- (30) Foreign Application Priority Data

May 27 2010 (CN) .....2010 1 0184787 --

Signed and Sealed this
Thirty-first Day of December, 2013

Margaret A. Focarino

Margaret A. Focarino
*Commissioner for Patents of the United States Patent and Trademark Office*